US010018361B2

(12) United States Patent
Seol

(10) Patent No.: US 10,018,361 B2
(45) Date of Patent: Jul. 10, 2018

(54) PINTLE-SWIRL HYBRID INJECTION DEVICE

(71) Applicant: KOREA AEROSPACE RESEARCH INSTITUTE, Daejeon (KR)

(72) Inventor: Woo Seok Seol, Daejeon (KR)

(73) Assignee: KOREA AEROSPACE RESEARCH INSTITUTE, Daejeon (KR)

( * ) Notice: Subject to any disclaimer, the term of this patent is extended or adjusted under 35 U.S.C. 154(b) by 48 days.

(21) Appl. No.: 14/958,921

(22) Filed: Dec. 3, 2015

(65) Prior Publication Data

US 2016/0178205 A1 Jun. 23, 2016

(30) Foreign Application Priority Data

Dec. 18, 2014 (KR) ..... 10-2014-0183321

(51) Int. Cl.
*F23R 3/28* (2006.01)

(52) U.S. Cl.
CPC ..... *F23R 3/28* (2013.01)

(58) Field of Classification Search
CPC .... F23R 3/28; F23R 3/343; F23R 3/14; F23R 3/36; F23D 17/002
USPC ..... 239/399
See application file for complete search history.

(56) References Cited

U.S. PATENT DOCUMENTS 2,539,778 A * 1/1951 Grimmeisen ..... F23D 11/04 239/214
2,612,405 A * 9/1952 Kirschbaum ..... B05B 7/0416 239/404
3,512,719 A * 5/1970 Phelps et al. ..... B05B 7/10 239/405
3,638,865 A * 2/1972 McEneny ..... F23D 11/26 239/404
3,717,306 A * 2/1973 Hushon ..... B05B 7/0408 239/404
3,804,333 A * 4/1974 Kramer ..... F23G 7/05 239/124
4,094,469 A * 6/1978 Woringer ..... F02M 43/04 239/399
2004/0006992 A1* 1/2004 Stuttaford ..... F23R 3/286 60/776
2010/0192581 A1* 8/2010 Ziminsky ..... F23R 3/286 60/737

FOREIGN PATENT DOCUMENTS

JP 5230795 B2 7/2013
KR 20-0198903 Y1 10/2000
KR 2012-0112798 A 10/2012

* cited by examiner

*Primary Examiner* — Chee-Chong Lee
(74) *Attorney, Agent, or Firm* — Rabin & Berdo, P.C.

(57) ABSTRACT

A pintle-swirl hybrid injection device according to embodiments of the present disclosure is an injection device which is installed inside a housing that defines a combustion chamber to inject propellant toward the combustion chamber, and it includes a body in tubular shape, being installed in the housing, forming a passage through which the propellant is introduced, and being partially exposed to the combustion chamber, and an injection tip coupled with an end of the body exposed to the combustion chamber to inject the propellant introduced through the passage in a radial direction of the body, and at the same time, to inject the propellant to a direction of a central axis of the body.

13 Claims, 6 Drawing Sheets

PINTLE-SWIRL HYBRID INJECTION DEVICE

CROSS-REFERENCE TO RELATED APPLICATIONS

This application claims priority from Korean Patent Application No. 10-2014-0183321, filed on Dec. 18, 2014 in the Korean Intellectual Property Office, the disclosure of which is incorporated herein by reference in its entirety.

BACKGROUND

1. Field of the Invention

The present disclosure relates to a pintle-swirl hybrid injection device.

2. Description of the Related Art

Referring to FIGS. 6 and 7, engines in launch vehicles with a conventional injection device such as rockets and so on generally include a housing 3 defining a combustion chamber 3*a* therein, and an injection device 100 installed at a center of the housing 3.

Referring to FIGS. 6 and 7, the injection device 100 includes a body 110 in a tubular shape, which is installed in the housing 3 with one side being exposed toward the combustion chamber 3*a*, and an injection tip 120 coupled with the end of the side of the body 110 exposed to the combustion chamber 3*a*.

An oxidizer flow passage 110*a* is defined inside the body 110 to supply the oxidizer, and the oxidizer flow passage 110*a* is fluidly communicated with the combustion chamber 3*a* to inject the oxidizer to outside.

In the above example, the injection tip 120 is coupled with an one side end of the body 110 and determines an injection direction of the oxidizer injected to outside. That is, the oxidizer is injected from the body 110 by the injection tip 120 coupled with the one side end of the body 110, in a radial direction of the body 110 and in a diagonal fashion toward the combustion chamber 3*a*.

Meanwhile, a fuel flow passage 100*b* is formed between the housing 3 and the injection device 100, through which the fuel is supplied toward the combustion chamber 3*a*. Specifically, the fuel flow passage 100*b* to supply the fuel is formed along an outer wall of the body 110 of the injection device 100 installed in the housing 3, and the fuel flow passage 100*b* is formed in a structure such that the fuel flowing therein is injected toward the combustion chamber 3*a* in the axial direction of the body 110.

Accordingly, the oxidizer injected from the body 110 toward the combustion chamber 3*a* in the radial direction of the body 110, and the fuel injected along the outer surface of the body 110 in the axial direction of the body 110 collide into each other, thus being sprayed and burnt into high-temperature and high-pressure gas.

However, by the conventional technologies, the high-temperature and high-pressure gas is formed in the radial direction of the body 110 and sprayed into the combustion chamber 3*a*. Accordingly, there occurs areas where the high-temperature and high-pressure gas re-circulates, i.e., at the front of the injection device 100 where the injection tip 120 is disposed, and in the radial direction of the body 110 which is exposed to the combustion chamber 3*a*.

Accordingly, the high-temperature and high-pressure gas re-circulating at the front of the injection device 100 heats the externally-exposed outer wall of the injection tip 120 and damages the injection tip 120, and the high-temperature and high-pressure gas re-circulating at the front of the body 110 exposed to the combustion chamber 3*a* turns into highly-concentrated fuel state, thus hindering efficient combustion.

Meanwhile, to address the problems mentioned above, the conventional technologies have utilized the method of coating a heat-resistant material on the outer surface of the injection tip 120. However, the method can only temporarily protect the injection tip 120 from the high-temperature and high-pressure gas, but is not suitable for long period of use.

RELATED ART DOCUMENTS

Patent Documents (Patent 1) U.S. Pat. No. 8,596,039

SUMMARY

Exemplary embodiments of the present inventive concept overcome the above disadvantages and other disadvantages not described above. Also, the present inventive concept is not required to overcome the disadvantages described above, and an exemplary embodiment of the present inventive concept may not overcome any of the problems described above.

According to an embodiment, a technical objective is to provide a pintle-swirl hybrid injection device which can protect an injection tip from high-temperature and high-pressure gas, and optimize the fuel/oxidizer mixture ratio between high-temperature and high-pressure gas re-circulating in a combustion chamber to thus provide efficient combustion.

In order to achieve the objectives mentioned above, according to an exemplary embodiment of the present disclosure, a pintle-swirl hybrid injection device is provided, which is installed inside a housing which defines a combustion chamber to inject a propellant to a direction of the combustion chamber includes a body in tubular shape, being installed in the housing, defining therein a passage through which the propellant is introduced, and being partially exposed to the combustion chamber, and an injection tip coupled with an end of the body exposed to the combustion chamber to inject the propellant introduced through the passage in a radial direction of the body and concurrently inject the propellant to a direction of a central axis of the body.

The injection tip may include a first injector being coupled with the body and comprising an injection hole in an outer circumference to inject the propellant in the radial direction of the body, and a second injector installed in the first injector to inject the propellant in a conical shape to the direction of the central axis of the body.

The injection hole may include a plurality of injection holes spaced at uniform interval around the outer circumference of the first injector, and may be formed perpendicularly to the direction of the central axis of the body.

A mount hole may be formed in a front surface of the first injector to mount the second injector therein.

A discharge passage may be formed inside the second injector in fluid communication with the combustion chamber to inject the propellant to the direction of the central axis of the body, and a through hole may be formed in an outer circumference of the second injector in fluid communication with the discharge passage and an inner space of the first injector so that the propellant is introduced therethrough.

One side end of the second injector, which is received in the inner space of the first injector, may be formed in an oval shape.

The through hole may include a plurality of through holes spaced at uniform interval along the outer circumference of the second injector.

The through hole may be formed at a location eccentric to a center of the second injector.

The through hole may be formed in a tangential direction of an inner circumference of the second injector which defines the discharge passage.

The through hole may be formed perpendicularly to a direction of the central axis of the second injector.

The through hole may be formed at a slope with respect to the direction of the central axis of the second injector.

An inclined surface may be formed on an inner surface of the second injector so that a cross section of the discharge passage is decreased as it becomes closer to an injection direction of the propellant.

According to exemplary embodiments, the propellant is injected through the injection tip in the radial direction of the body and is concurrently injected to the direction of the central axis of the body. As a result, the mixture ratio between the fuel and oxidizer of the high-temperature and high-pressure gas re-circulating at the front of the injection tip and in the radial direction of the injection tip is optimized, thus allowing efficient combustion, and since the injection tip is protected from the high-temperature and high-pressure gas, performance of the device can be enhanced.

BRIEF DESCRIPTION OF THE DRAWINGS

The above and/or other aspects of the present inventive concept will be more apparent by describing certain exemplary embodiments of the present inventive concept with reference to the accompanying drawings, in which.

DETAILED DESCRIPTION OF EXEMPLARY EMBODIMENTS

Certain exemplary embodiments of the present inventive concept will now be described in greater detail with reference to the accompanying drawings.

Hereinbelow, an example of a pintle-swirl hybrid injection device according to an exemplary embodiment employed in a rocket engine will be described. However, the present disclosure is not limited to any specific example only, but can be applied in various types of engines.

Figure 1:
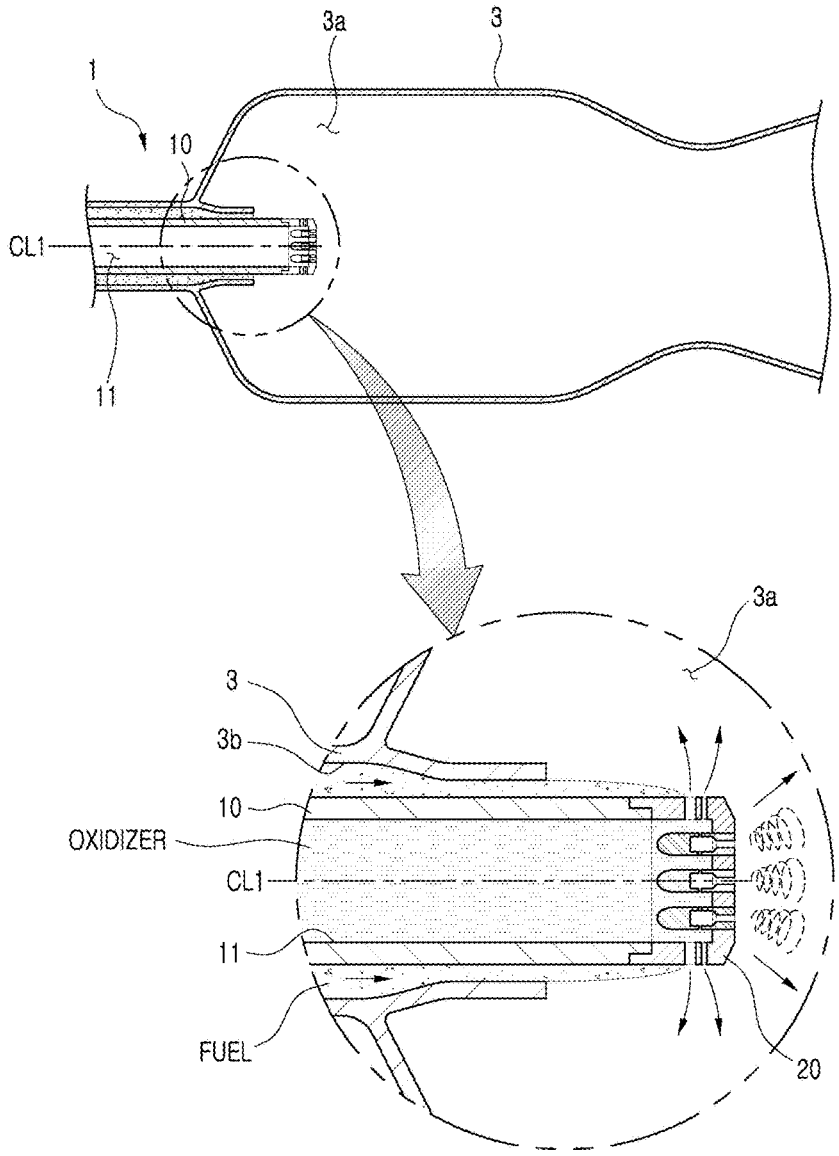
FIG. 1 is a schematic perspective view of a combustion chamber with a pintle-swirl hybrid injection device installed therein according to an exemplary embodiment installed therein.
Figure 2:
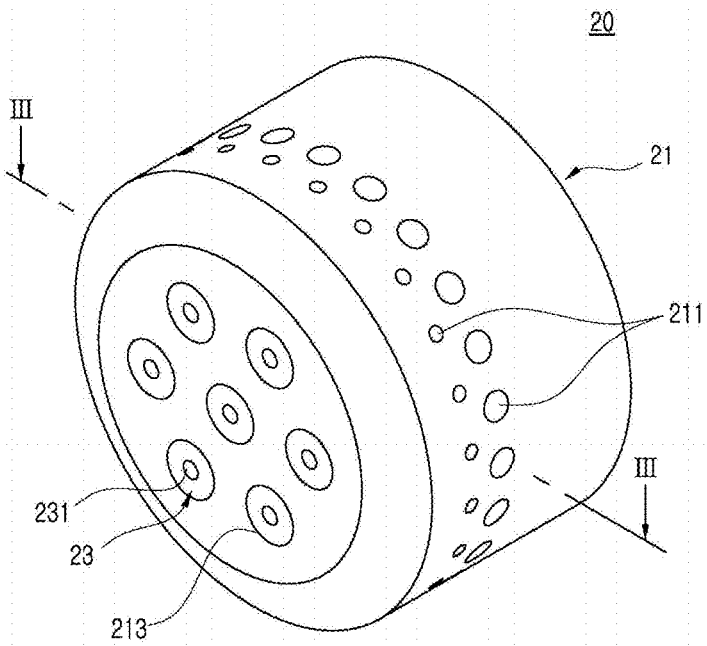
FIG. 2 is a perspective view of an injection tip of an injection device according to an exemplary embodiment.
Figure 3:
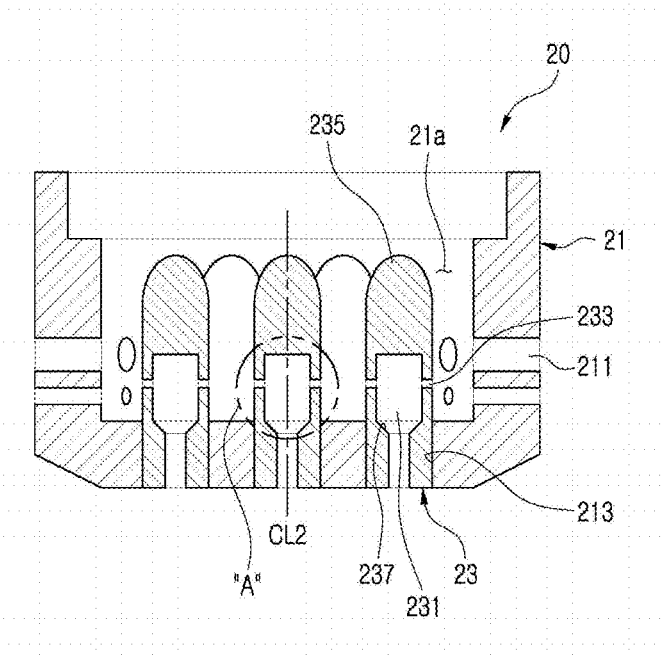
FIG. 3 is a cross-sectional view taken on line of FIG. 2.

FIG. 1 is a schematic perspective view of a combustion chamber with a pintle-swirl hybrid injection device installed therein according to an exemplary embodiment installed therein, FIG. 2 is a perspective view of an injection tip of an injection device according to an exemplary embodiment, and FIG. 3 is a cross-sectional view taken on line of FIG. 2.

Referring to FIG. 1, a pintle-swirl hybrid injection device 1 (hereinbelow, 'injection device') according to an exemplary embodiment may be installed inside the housing 3 that defines a combustion chamber 3*a* in an engine of a launch vehicle such as a rocket to inject a propellant (oxidizer) to a direction of the combustion chamber 3*a*, and may include a body 10 installed in the housing 3, and an injection tip 20 coupled with an end of the body 10.

More specifically, the injection device 1 may include the body 10 in a tubular shape installed in the housing 3, defining a passage 11 therein through which the propellant is introduced, and the injection tip 20 coupled with the end of the body 10 exposed to the combustion chamber 3*a* to inject the propellant introduced through the passage 11 in a radial direction of the body 10 and concurrently inject the propellant to a direction of a central axis CL1 of the body 10.

Referring to FIG. 1, another passage, i.e., a fuel flow passage 3*b*, is formed outside the body 10, through which a fuel is introduced.

Accordingly, the oxidizer injected in the radial direction of the body 10 is collided with the fuel which is injected from the fuel flow passage 3*b* along the outer wall of the body 10 to the direction of the combustion chamber 3*a*, thus burning into high-temperature and high-pressure gas and then sprayed to the combustion chamber 3*a*.

Hereinbelow, the injection tip 20 will be described in detail with reference to the drawings.

Referring to FIGS. 2 and 3, the injection tip 20 may include a first injector <('pintle injector') coupled with the body 10 and having an injection hole 211 formed in an outer circumference to inject the propellant in the radial direction of the body 10, and a second injector 23 ('swirl injector') installed in the first injector 21 to inject the propellant in a conical shape to the direction of the central axis CL1.

The first injector 21 may be formed in a shape of a circular cup with one open side, and may have the injection hole 211 described above in the outer circumference, and a coupling means (not illustrated) formed on the one open side for coupling with the end of the body 10.

For example, for coupling with the first injector 21, the body 10 may include another coupling means on an inner or outer surface corresponding to the coupling means of the first injector 21, in which the coupling means may be formed as screws, hooks, and so on having a corresponding structure.

As illustrated in FIG. 2, there may be a plurality of injection holes 211 formed at uniform spacing around the outer circumference of the first injector 21.

Further, the injection holes 211 may be formed perpendicularly to the direction of the central axis CL1 of the body 10.

More specifically, the injection holes 211 may be formed at a predetermined angle with respect to the direction of the central axis CL1 of the body 10, by considering the angle of collision between the fuel (see FIG. 1) being injected along the outer wall of the body 10 toward the combustion chamber 3*a* and the propellant being injected in the radial direction through the injection holes 211.

That is, although the injection holes 211 may be formed at a variety of angles with respect to the direction of the central axis CL1 of the body 10 by considering the collision between the respective propellants, the injection holes 211 in an exemplary embodiment may preferably be formed at a right angle with respect to the direction of the central axis CL1 of the body 10 to maximize the effect of collision.

Meanwhile, a mount hole 213 to mount the second injector 23 (described below) therein may be formed in a front surface of the first injector 21.

According to a size of the first injection hole 21, there may be one mount hole 213 or a plurality of mount holes 213 formed in a front surface of the first injector 21 along with the second injector 23. For example, there may be one mount hole 213 in a front center of the first injector 21, or as illustrated in FIG. 2, there may be a plurality of mount holes 213 formed in a front center and also formed at uniform spacing in a circumferential direction around the center.

Further, the mount hole 213 may be formed in a shape corresponding to the outer surface of the second injector 23. For example, the mount hole 213 may have a coupling means (not illustrated), and the second injector 23 coupled with the mount hole 213 may have a coupling means (not illustrated) on an outer circumference.

Next, the second injector 23 will be described.

Referring to FIG. 3, the second injector 23 is formed in a cylindrical shape with one closed side, in which the one closed side is received in an inner space 21*a* of the first injector 21 and the other open side is coupled with the mount hole 213 formed in the first injector 21.

In this case, an end of the one closed side of the second injector 23, which is received in the inner space 21*a* of the first injector 21, may be formed in an oval shape.

As illustrated in FIG. 3, an one side end 235 of the second injector 23, which is disposed opposite to a direction that the propellant is introduced, is formed in the oval shape so as to guide the propellant flow to the direction of the second injector 23 by naturally dispersing the propellant flow as introduced without blocking the propellant flow, thus preventing generation of eddy current of the propellant in the inner space 21*a* of the first injector 21. For example, the oval shape may include a circular shape.

Further, a discharge passage 231 may be formed inside the second injector 23 in fluid communication with the combustion chamber 3*a* to inject the propellant to the direction of the central axis CL1 of the body 10, and a through hole 233 may be formed in the outer circumference of the second injector 23 in fluid communication with the discharge passage 231 and the inner space 21*a* of the first injector 21 so that the propellant is introduced thereinto.

Figure 4:
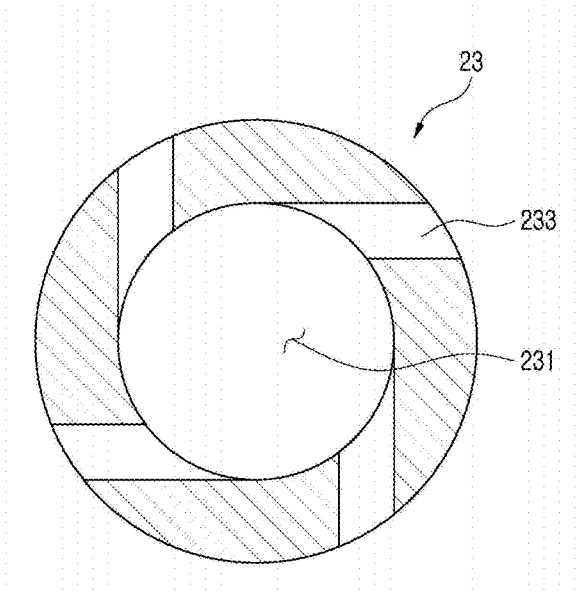
FIG. 4 is a schematic illustration of through holes formed in a second injector of an injection device according to an exemplary embodiment.
Figure 5:
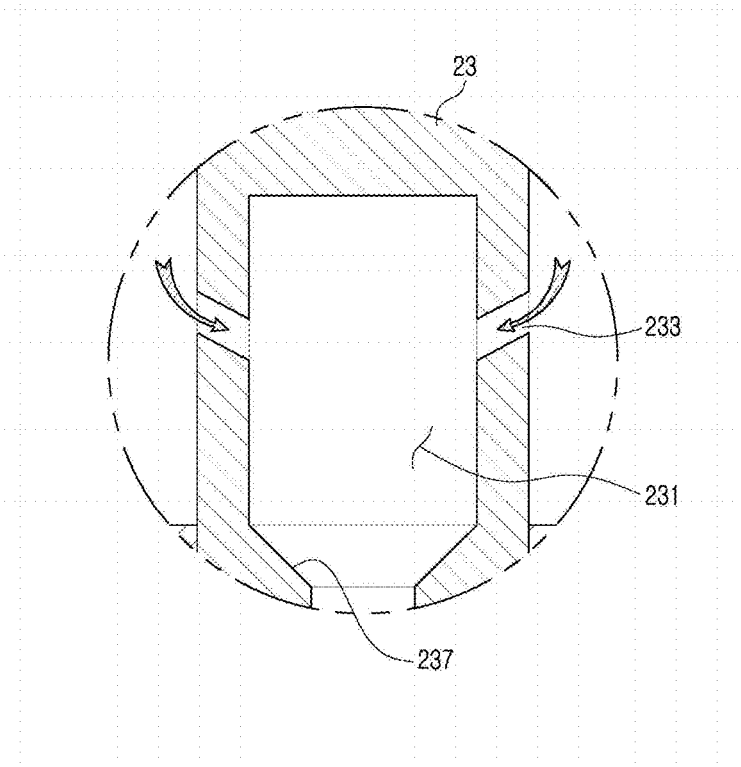
FIG. 5 is a schematic illustration of the encircled area "A" of FIG. 3 according to another exemplary embodiment.
Figure 6:
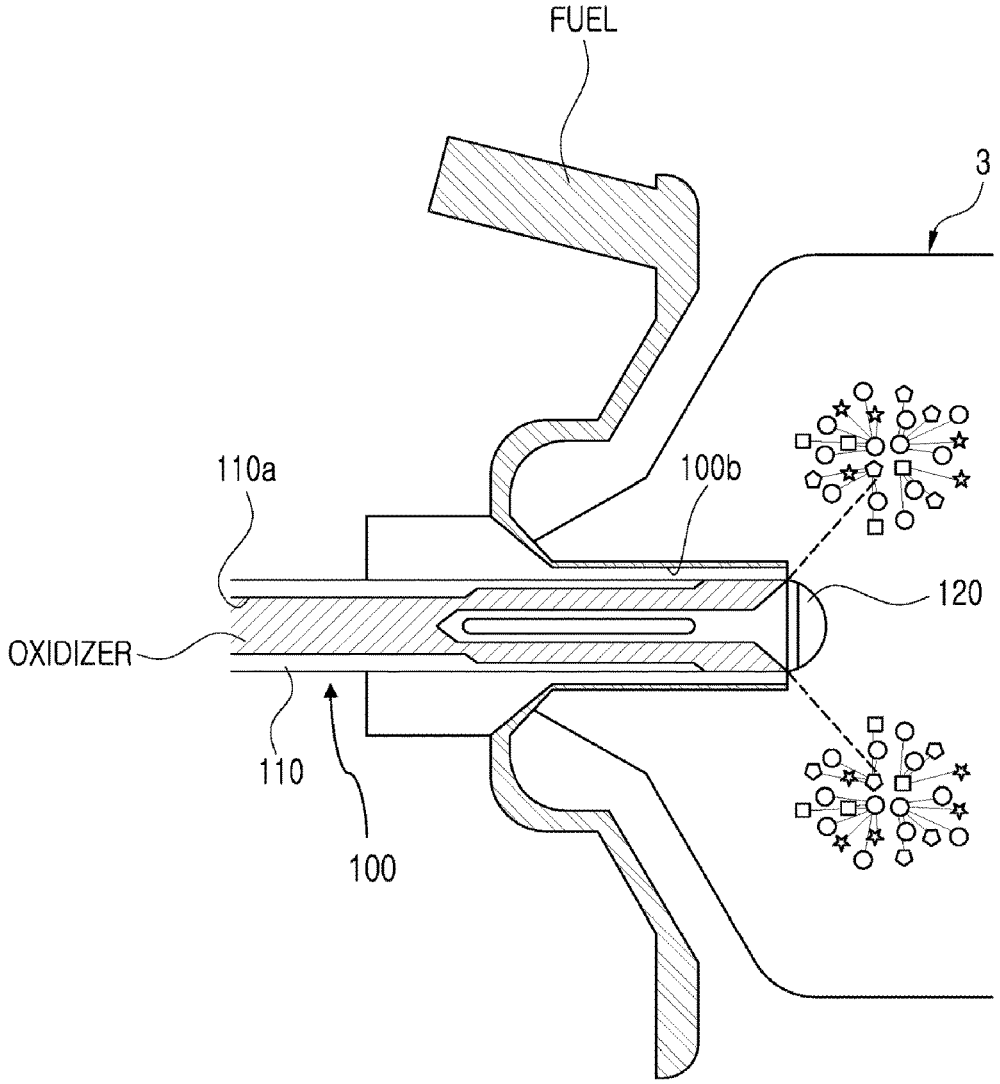
FIG. 6 PRIOR ART
FIG. 6 is a schematic cross-sectional view of an engine of a launch vehicle with a conventional injection device installed therein.
Figure 7:
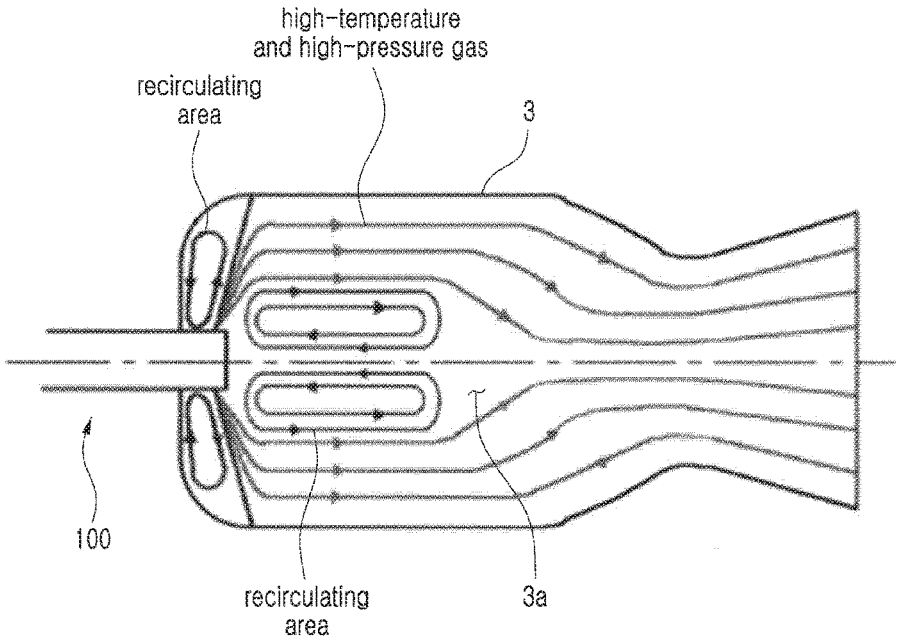
FIG.7 PRIOR ART
FIG. 7 is a schematic illustration of a circulation structure of the propellant injected from a conventional propellant injection device.

FIG. 4 is a schematic illustration of through holes formed in a second injector of an injection device according to an exemplary embodiment, and FIG. 5 is a schematic illustration of the encircled area "A" of FIG. 3 according to another exemplary embodiment.

Referring to FIG. 4, the through hole 233 may be located eccentrically with respect to the center of the second injector 23.

More specifically, as the through hole 233 is formed at a location eccentric with respect to the center of the second injector 23, a swirl of the propellant introduced into the through hole 233 may be generated in the discharge passage 231. That is, the propellant introduced through the through hole 233 into the discharge passage 231 is rotated along the inner surface of the second injector 23, moving to the direction of the central axis CL2 of the second injector 23 and generating a swirl in the discharge passage 231. Accordingly, the propellant may be injected into the combustion chamber 3*a* in the conical shape.

In this case, to maximize the generation of the swirl, there may be a plurality of through holes 233 formed along the outer circumference of the second injector 23 at uniform intervals and in a tangential direction to the inner circumference of the second injector 23 which defines the discharge passage 231.

Further, the through hole 233 may be formed basically perpendicular to the direction of the central axis CL2 of the second injector 23 as illustrated in FIG. 3, but not limited thereto. Accordingly, as illustrated in FIG. 5, the through hole 233 may be inclined with respect to the direction of the central axis CL2 of the second injector.

That is, the through hole 233 may be formed at a slope with respect to the central axis CL2 of the second injector 23 to the direction in which the propellant is introduced.

Accordingly, the propellant may be introduced to the discharge passage 231 more efficiently, compared to an example in which the through hole 233 is formed perpendicularly to the central axis CL2 of the second injector 23.

Meanwhile, an inclined surface 237 may be formed on the inner surface of the second injector 23 so that the cross section of the discharge passage 231 is decreased in size as it becomes closer to the direction where the propellant is injected.

Accordingly, the propellant injection velocity can be enhanced as the pressure of the propellant is turned into speed.

As described above, according to exemplary embodiments, the propellant is injected through the injection tip 20 in the radial direction of the body 10 and concurrently injected to the direction of the central axis CL1 of the body 10. As a result, the mixture ratio between the fuel and oxidizer of the high-temperature and high-pressure gas re-circulating at the front of the injection tip 20 and in the radial direction of the injection tip 20 is optimized, thus allowing efficient combustion, and since the injection tip 20 is protected from the high-temperature and high-pressure gas, performance of the device can be enhanced.

The foregoing exemplary embodiments and advantages are merely exemplary and are not to be construed as limiting the exemplary embodiments. The present teaching can be readily applied to other types of apparatuses. Also, the description of the exemplary embodiments of the present inventive concept is intended to be illustrative, and not to limit the scope of the claims.

What is claimed is:

1. A pintle-swirl hybrid injection device installed inside a housing which defines a combustion chamber to inject an oxidizer to a direction of the combustion chamber, the pintle-swirl hybrid injection device comprising:

a body in tubular shape, being installed in the housing, defining therein a passage through which the oxidizer is introduced, and being partially exposed to the combustion chamber, wherein the passage is an internal space of the body encompassing a center of the body such that the center of the body is a part of the internal space, and the internal space extends from the center of the body to an inner wall of the body without discontinuity; and an injection tip coupled with an end of the body exposed to the combustion chamber to inject the oxidizer introduced through the passage in a radial direction of the body and concurrently inject the oxidizer to a direction of a central axis of the body, wherein the injection tip comprises:

a first injector being coupled with the body and comprising an injection hole in an outer circumference through which the oxidizer is injected to the combustion chamber in the radial direction of the body, the injection hole being in fluid communication with the passage of the body such that the oxidizer is allowed to flow from the center of the body to the injection hole; and a second injector installed in the first injector and comprising a discharge passage through which the oxidizer is injected to the combustion chamber in a conical shape to the direction of the central axis of the body, the discharge passage being in fluid communication with the passage of the body and an inner space of the first injector.

2. The pintle-swirl hybrid injection device of claim 1, wherein the injection hole comprises a plurality of injection holes spaced at uniform interval around the outer circumference of the first injector, and is formed perpendicularly to the direction of the central axis of the body.

3. The pintle-swirl hybrid injection device of claim 1, wherein a mount hole is formed in a front surface of the first injector to mount the second injector therein.

4. The pintle-swirl hybrid injection device of claim 1, wherein a through hole is formed in an outer circumference of the second injector through which the discharge passage is in fluid communication with the inner space of the first injector so that the oxidizer is introduced therethrough.

5. The pintle-swirl hybrid injection device of claim 4, wherein one side end of the second injector, which is received in the inner space of the first injector, is formed in an oval shape.

6. The pintle-swirl hybrid injection device of claim 4, wherein the through hole comprises a plurality of through holes spaced at uniform interval along the outer circumference of the second injector.

7. The pintle-swirl hybrid injection device of claim 4, wherein the through hole is formed at a location eccentric to a center of the second injector.

8. The pintle-swirl hybrid injection device of claim 7, wherein the through hole is formed in a tangential direction of an inner circumference of the second injector which defines the discharge passage.

9. The pintle-swirl hybrid injection device of claim 4, wherein the through hole is formed perpendicularly to a direction of the central axis of the second injector.

10. The pintle-swirl hybrid injection device of claim 4, wherein the through hole is formed at a slope with respect to the direction of the central axis of the second injector.

11. The pintle-swirl hybrid injection device of claim 4, wherein an inclined surface is formed on an inner surface of the second injector so that a cross section of the discharge passage is decreased as it becomes closer to an injection direction of the oxidizer.

12. The pintle-swirl hybrid injection device of claim 1, wherein the first injector is configured such that the oxidizer injected from the injection hole of the first injector in the radial direction of the body collides with a fuel injected along an outer surface of the body in the axial direction of the body, the fuel not being introduced into the body.

13. A combination of a housing and a pintle-swirl hybrid injection device, wherein:

the housing includes a first wall and a second wall extending from the first wall, the second wall defining a combustion chamber; and the pintle-swirl hybrid injection device is installed inside the housing to inject an oxidizer to the combustion chamber, the pintle-swirl hybrid injection device comprising:

a body in tubular shape, being installed in the housing to be surrounded by the first wall of the housing and being partially exposed to the combustion chamber, wherein:

an oxidizer passage through which the oxidizer is introduced is defined within the body, the oxidizer passage being an internal space of the body encompassing a center of the body such that the center of the body is a part of the internal space, and the internal space extends from the center of the body to an inner wall of the body without discontinuity; and a fuel flow passage through which a fuel is introduced is formed between an outer surface of the body and the first wall of the housing; and an injection tip coupled with an end of the body exposed to the combustion chamber to inject the oxidizer introduced through the oxidizer passage in a radial direction of the body and concurrently inject the oxidizer to a direction of a central axis of the body, wherein the injection tip comprises:

a first injector being coupled with the body and comprising an injection hole in an outer circumference through which the oxidizer is injected to the combustion chamber in the radial direction of the body, the injection hole being in fluid communication with the passage of the body, wherein the oxidizer injected from the injection hole of the first injector in the radial direction of the body collides with the fuel injected along the outer surface of the body in the axial direction of the body from the fuel flow passage, the fuel not being introduced into the body such that the oxidizer is allowed to flow from the center of the body to the injection hole, a second injector installed in the first injector and comprising a discharge passage through which the oxidizer is injected to the combustion chamber in a conical shape to the direction of the central axis of the body, the discharge passage being in fluid communication with the passage of the body and an inner space of the first injector.

* * * * *